US008718901B2

(12) United States Patent
Brewster et al.

(10) Patent No.: US 8,718,901 B2
(45) Date of Patent: May 6, 2014

(54) CONTROL OF CONTROLLED-AUTO-IGNITION (CAI) COMBUSTION PROCESS

(75) Inventors: Simon C. Brewster, Kallaroo (AU); Geoffrey P. Cathcart, Mount Lawley (AU)

(73) Assignee: Orbital Australia Pty Limited, Balcatta (AU)

( * ) Notice: Subject to any disclaimer, the term of this patent is extended or adjusted under 35 U.S.C. 154(b) by 916 days.

(21) Appl. No.: 12/665,765

(22) PCT Filed: Jun. 20, 2008

(86) PCT No.: PCT/AU2008/000910

§ 371 (c)(1),
(2), (4) Date: Jun. 1, 2010

(87) PCT Pub. No.: WO2009/000022

PCT Pub. Date: Dec. 31, 2008

(65) Prior Publication Data

US 2010/0235068 A1 Sep. 16, 2010

(30) Foreign Application Priority Data

Jun. 22, 2007 (AU) ..... 2007903385

(51) Int. Cl.
*F02M 67/02* (2006.01)

(52) U.S. Cl.
USPC ..... 701/103; 123/294; 123/531; 123/533; 123/585; 123/588

(58) Field of Classification Search
USPC ..... 123/294, 295, 531, 533, 585, 588; 701/103
See application file for complete search history.

(56) References Cited

U.S. PATENT DOCUMENTS

| | | | | |
|---|---|---|---|---|
| 5,832,880 | A * | 11/1998 | Dickey | 123/25 C |
| 6,640,754 | B1 * | 11/2003 | Iida | 123/27 R |
| 7,013,212 | B1 | 3/2006 | de Ojeda et al. | |
| 7,421,999 | B2 * | 9/2008 | Kim et al. | 123/295 |
| 8,215,292 | B2 * | 7/2012 | Bryant | 123/559.1 |
| 2002/0179067 | A1 | 12/2002 | Liedtke et al. | |
| 2003/0116106 | A1 | 6/2003 | Clarke | |
| 2005/0092306 | A1 * | 5/2005 | Shinogle et al. | 123/531 |
| 2005/0235951 | A1 | 10/2005 | Weber et al. | |
| 2007/0215120 | A1 | 9/2007 | Koopmans et al. | |

FOREIGN PATENT DOCUMENTS

| | | | |
|---|---|---|---|
| DE | 102005042661 | A1 | 3/2007 |
| JP | 2005-325748 | A | 11/2005 |
| JP | 2006-017020 | A | 1/2006 |
| WO | WO2005/095768 | * | 10/2005 |

OTHER PUBLICATIONS

International Preliminary Report on Patentability for PCT/AU2008/000910, mailed Oct. 8, 2009.

* cited by examiner

*Primary Examiner* — Erick Solis

(57) ABSTRACT

A method for controlling controlled-auto-ignition operation in an eternal combustion engine is described. The method includes the injection of air into a combustion cylinder at an appropriate time in the combustion cycle in response to measured conditions. The injection of air acts to alter the CAI-phasing, thus providing the ability to extend the CAI operation further into a vehicle speed/load range.

23 Claims, 14 Drawing Sheets

CONTROL OF CONTROLLED-AUTO-IGNITION (CAI) COMBUSTION PROCESS

CROSS-REFERENCE TO RELATED APPLICATIONS

This application is a U.S. National Phase of International Application No. PCT/AU2008/000910, entitled "CONTROL OF CONTROLLED-AUTO-IGNITION (CAI) COMBUSTION PROCESS," filed Jun. 20, 2008, which claims priority to Australian Patent Application No. 2007903385, entitled "CONTROL OF CONTROLLED-AUTO-IGNITION (CAI) COMBUSTION PROCESS," filed Jun. 22, 2007.

FIELD OF THE INVENTION

The present invention relates to the control of a controlled-auto-ignition (CAI) combustion process in an internal combustion engine.

BACKGROUND TO THE INVENTION

In light of dwindling oil reserves, geo-political uncertainties and increased concern over the environmental impacts of burning fossil fuels, there is a well recognised need to improve the efficiency of fuel use. This need is particularly apparent in relation to internal combustion engines, which are expected to power most of the world's transport needs over coming decades.

Additionally, increasingly stringent emissions requirements for pollutants such as unburnt hydrocarbons, carbon monoxide and nitrogen oxides ($NO_x$) require internal combustion engines to burn fuel in conditions which mitigate against the formation of these pollutants.

It is thus necessary to have good control of the combustion process.

A great deal of research has been conducted into understanding and controlling the two principal combustion processes used in internal combustion engines, namely spark-ignition (SI) and compression-ignition (CI). In an SI engine, a spark ignites a compressed air/fuel mixture within a cylinder. The actual ignition takes over a period of time, as a flame front travels outwardly from the spark. In a CI ignition, fuel ignites as it is injected into the cylinder. Again, the ignition occurs over a period of time, being the time taken to complete the injection of fuel. In both SI and CI engines pressures and temperatures within the cylinder and on the piston form a gradient relative to the changes taking place over the time of ignition.

It has long been recognised that greater theoretical fuel efficiencies and/or reduction of engine emissions can be gained from an alternative combustion process, namely controlled auto-ignition or homogeneous charge compression ignition (HCCI). In a CAI combustion process, fuel is introduced into a cylinder and then compressed to a point where its temperature induces self-ignition. Ignition is typically induced at multiple sites, as the temperature and pressure are largely uniform. CAI combustion is generally distinguished by a significantly lower combustion temperature than SI or CI combustion, and as a consequence typically results in significantly lower NO emissions. Further, in comparison with CI combustion processes, CAI combustion processes have lower particulate matter emissions, thus reducing cost and complexity in the exhaust gas after-treatment system of such CI engines.

There are known limitations in the use of CAI combustion. Principal among these are excess rates of heat release and cylinder pressure rise during high engine load or speed, which can result in undesirable engine knocking. These factors cause an effective upper boundary of the speeds and/or loads where CAI combustion can be used. CAI combustion is therefore generally more suited to engine operation at lower speeds and/or loads.

The use of CAI combustion can also be problematic below an effective lower boundary of speed and load, particularly at engine idle. At or near idle it can be difficult to obtain sufficient heat to cause the necessary temperature rise for CAI conditions. This can result in a mis-fire within a cylinder.

Known CAI combustion processes are thus limited in their range of operation. In many engine applications this limited range is not sufficient, and therefore an engine must be configured to operate in CAI mode in a portion of its range and in SI or CI mode outside this range.

The limited range in which CAI combustion can be operated greatly reduces its commercial viability. Further, the need for a smooth transition between two combustion modes having different efficiencies and emission characteristics presents significant challenges. Resolution of these issues is largely dependent on the degree to which the CAI combustion process can be controlled.

An example of a typical range of operation for CAI combustion is shown in FIG. 1*b*.

As CAI combustion is initiated by temperature, it is important to raise the temperature within the cylinder prior to combustion—that is, the temperature of the charge—in comparison with that required by SI and CI combustion processes. This is typically done by one of two means: heating the intake air and re-use or retention of exhaust gas.

Heating of intake air is generally not preferred for a number of reasons, including energy requirements, complexity of effective control and the need for a high compression ratio. Re-use or retention of exhaust gas is therefore preferred for current applications. In a CI combustion engine, the exhaust gas is typically re-used, by being re-circulated into the induction system through an appropriate valve. In a SI combustion engine, a portion of exhaust gas is typically retained in the cylinder for heating purposes, this being controlled through timing or profiling of induction and exhaust valve events.

The use of exhaust gas in this way presents particular challenges during transition between CAI and non-CAI modes of combustion. As noted above, one of the principal differences between modes is the temperature of exhaust gases. When these gases are being re-used or retained to provide an increased charge temperature, control of this to produce a desired in-cylinder temperature can be quite complex. Further, it will be apparent that the need for heat from exhaust gases typically means that an engine cannot be started in CAI combustion mode.

Many problems can arise if CAI combustion is not stable and well controlled. These include a risk of misfire, an increase in emissions, a reduction in efficiency, unacceptable levels of combustion noise and potential damage to the engine. Stability of the CAI combustion can be achieved by accurate control of the phasing (that is the timing of ignition) and the associated rate of heat release during the combustion process. Effective control of these parameters assists in operating the CAI combustion process at close to an optimum position, maximising the effective CAI-combustion operation range, and in providing effective transition between different combustion modes. Operation at an optimum position may relate to minimising of combustion noise, fuel consumption and/or engine exhaust emissions.

The key determinants of CAI-combustion operation are the temperature, pressure, concentration of reactants, movement of the reactants and the nature of the reactants. Of these, temperature is the most difficult parameter to control. In SI-combustion, control can be achieved by timing of the spark. In CI-combustion, control can be achieved through timing and apportionment of injection events. These options do not provide for adequate control of CAI-combustion. Further, as temperature and pressure may vary significantly from cylinder to cylinder and cycle to cycle it is preferable to both accurately measure these parameters and to control them on a per cycle basis within each cylinder.

Efforts have been made to achieve control of CAI combustion through developments in Engine Management System architecture, combustion sensing, and Engine Control Unit hardware and software. Developments in these areas have led to a greater ability to determine the cycle-by-cycle conditions in each cylinder, and therefore to analyse the nature (particularly the phase and rate) of the CAI combustion event. Even so, the ability to achieve effective control of this event is constrained by the capacity to alter in-cylinder temperature, pressure, composition and motion on an individual cylinder and per-cycle basis.

Adjustment of parameters such as intake air temperature, compression ratio and coolant temperature can be achieved in order to alter mean performance. These parameters generally cannot, however, be altered on a per-cylinder or per-cycle basis.

Temperature within a cylinder can be altered by altering the amount of exhaust gas retained or re-used. Adjustment of exhaust gas retention requires variable valve timing, which adds significant complexity to the engine design. Adjustment of exhaust gas re-use similarly requires complex porting arrangements.

The present invention seeks to provide a means of controlling CAI-combustion which is more effective than those outlined above in at least situations.

SUMMARY OF THE INVENTION

In accordance with a first aspect of the present invention, there is provided a method for controlling CAI-combustion within a cylinder, the method including injecting air into the cylinder to alter conditions within the cylinder prior to ignition in response to measured operating parameters. Typically, the conditions altered include the temperature and/or pressure, and the motion of the fuel/air mix within the cylinder. As a result the rate and phasing of auto-ignition, and thus the rate of heat release, can be controlled.

In accordance with a second aspect of the present invention, there is provided a method of enhancing stability of CAI-combustion within a cylinder employing exhaust-gas retention, the method including altering the timing of fuel and/or air injections into the cylinder according to engine speed and/or load.

The method may be deployed to enhance stability of CAI-combustion at or near engine idle by causing fuel to be injected into the cylinder earlier than when the engine is under load.

The method may be deployed to enhance stability of CAI-combustion under load by injecting additional air so as to retard combustion.

In one embodiment of the present invention, the air is injected using an air-assisted direct fuel injection system. In its simplest form, this is achieved by increasing the duration of air injection through the direct injection system without increasing the quantity of fuel injected.

Other methods include the use of multiple pulses of air, or of an air-fuel mix, during each cycle. This may be achieved by adding air pulses, or air-fuel pulses, before or after a primary air pulse. During low speed and load conditions, for example, an additional air-fuel injection event may be effected close to completion of an engine compression stroke. The additional fuel may be ignited by a spark, in order to increase the temperature and pressure within the cylinder sufficiently to cause auto-ignition of the earlier supplied fuel. This would, it is anticipated, enhance the combustion rate and phase.

In another embodiment of the invention, the cylinder may include a dedicated air injector separate from the fuel injection system, located in an optimal place for achieving control of the CAI combustion process. This location may provide for a greater degree of control of or effect on the temperature, mixing, and/or motion of the mixture within the cylinder.

The operating parameters measured may include the engine speed, engine vibration, engine torque, in-cylinder ionisation and/or in-cylinder pressure. The parameters may further include combustion chamber gas temperature measurement where such measurement can be effectively made.

Preferably, calculation of appropriate timings for air injection are made independently for each cylinder. In a most preferred aspect of the invention, the relevant determination is made for each successive cylinder cycle.

It will be appreciated that use of the method invention does not necessarily significantly alter the amount of air in the cylinder. Generally, the excess injected air is less than 5% of the air intake through the intake valve. Typically, it is about 2% to 3%.

Further control of the CAI-combustion process may be achieved with the inclusion or exclusion of a spark at an appropriate time in the cycle, or with a variation in the quantity of fuel delivered. This may be effected through a variation in the number, duration and timing of fuel injector pulses. The relative timing of air injection pulses, fuel injection pulses and/or ignition events may provide a particular mechanism for control.

BRIEF DESCRIPTION OF THE DRAWINGS

It will be convenient to further describe the invention with reference to the accompanying drawings which illustrate results of the method of the present invention. Other embodiments are possible, and consequently, the particularity of the accompanying drawings is not to be understood as superseding the generality of the preceding description of the invention. In the drawings.

DESCRIPTION OF EXAMPLES

Figure 1A:
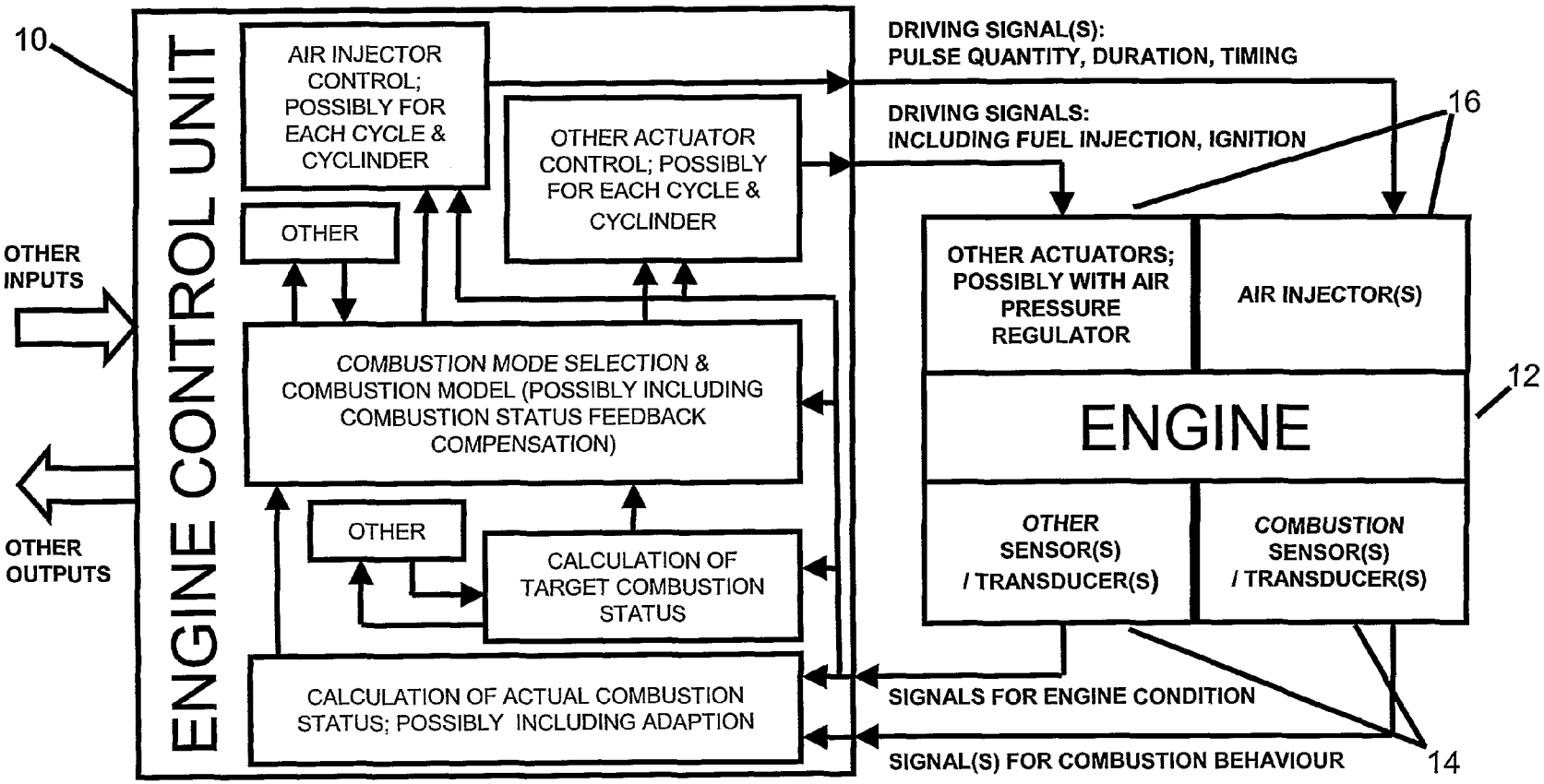
FIG. 1*a* is a schematic representation of a control system in accordance with the present invention.
Figure 1B:
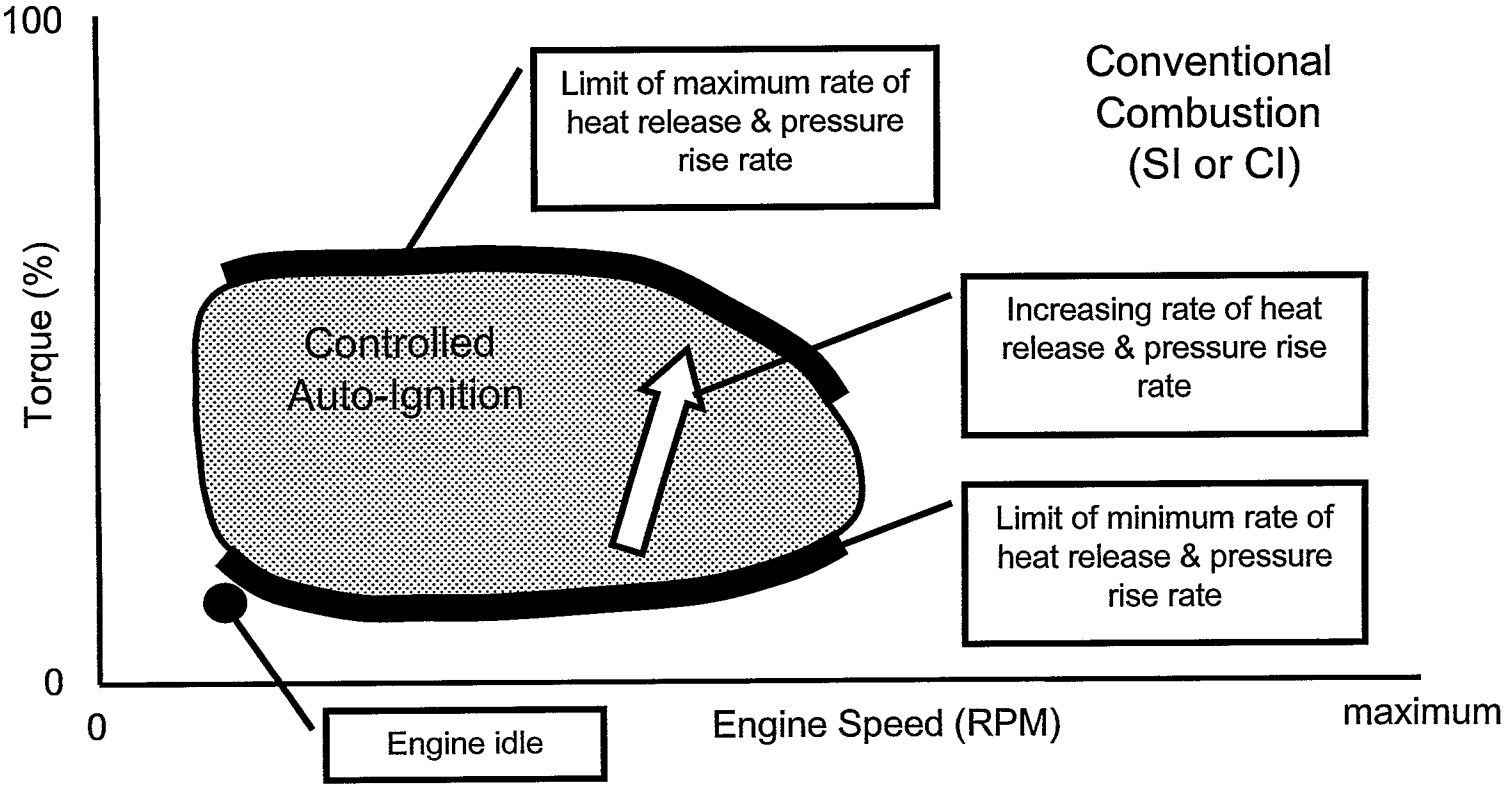
FIG. 1*b* is a schematic representation of the operating range of CAI combustion with regard to engine speed and load.

FIG. 1*a* shows a control system for effecting the method of the present invention, the control system comprising an electronic engine control unit 10 for controlling an engine 12. Principally, the control system embodies a loop structure in which the control unit 10 receives engine output signals from appropriate transducers 14, processes the signals, and provides instructions to engine actuators 16 including air injectors to modify the combustion process within the engine 12.

The control unit 10 firstly determines the present combustion mode of the relevant cylinder. It then determines whether this mode is suitable.

Having determined the combustion mode in which the cylinder should operate, the control unit 10 determines the timing and duration of relevant events, notable air injection, to achieve a desired result. These timings are provided to the actuators 16. One method of achieving this is for a determination of combustion status to made on the basis of the information supplied by the transducers 14. This measured or actual combustion status can be compared to a desired combustion status, as influenced by the determination of suitable combustion mode. The control unit 10 will then calculate the required events to bring combustion status towards its desired status, and provide instructions to the actuators 16 accordingly.

In one embodiment of the control system, the control unit 10 may determine target conditions according to engine torque. In this embodiment, when engine torque is increased and combustion rate increases beyond an optimum range, then adjustment of air injector parameters may be effected to reduce the combustion rate.

As will be apparent from FIGS. 2 to 13, the injection of additional air achieved by an increase in the air pulse duration has a significant effect on the output of an engine cylinder.

Figure 2:
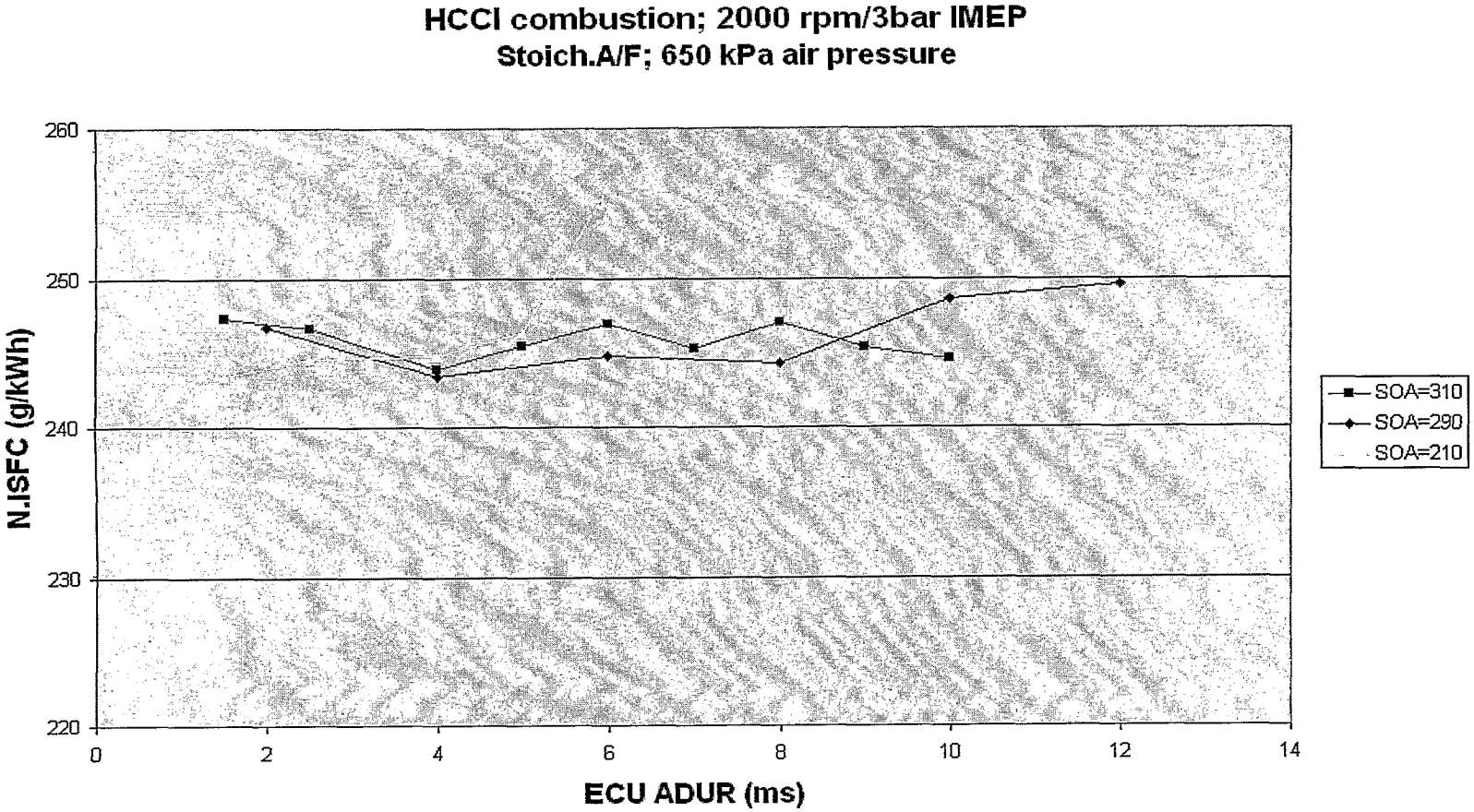
FIG. 2 is a graph demonstrating the effect of air pulse duration in accordance with the method of the present invention on indicated specific fuel consumption, shown for three different injection timings.
Figure 3:
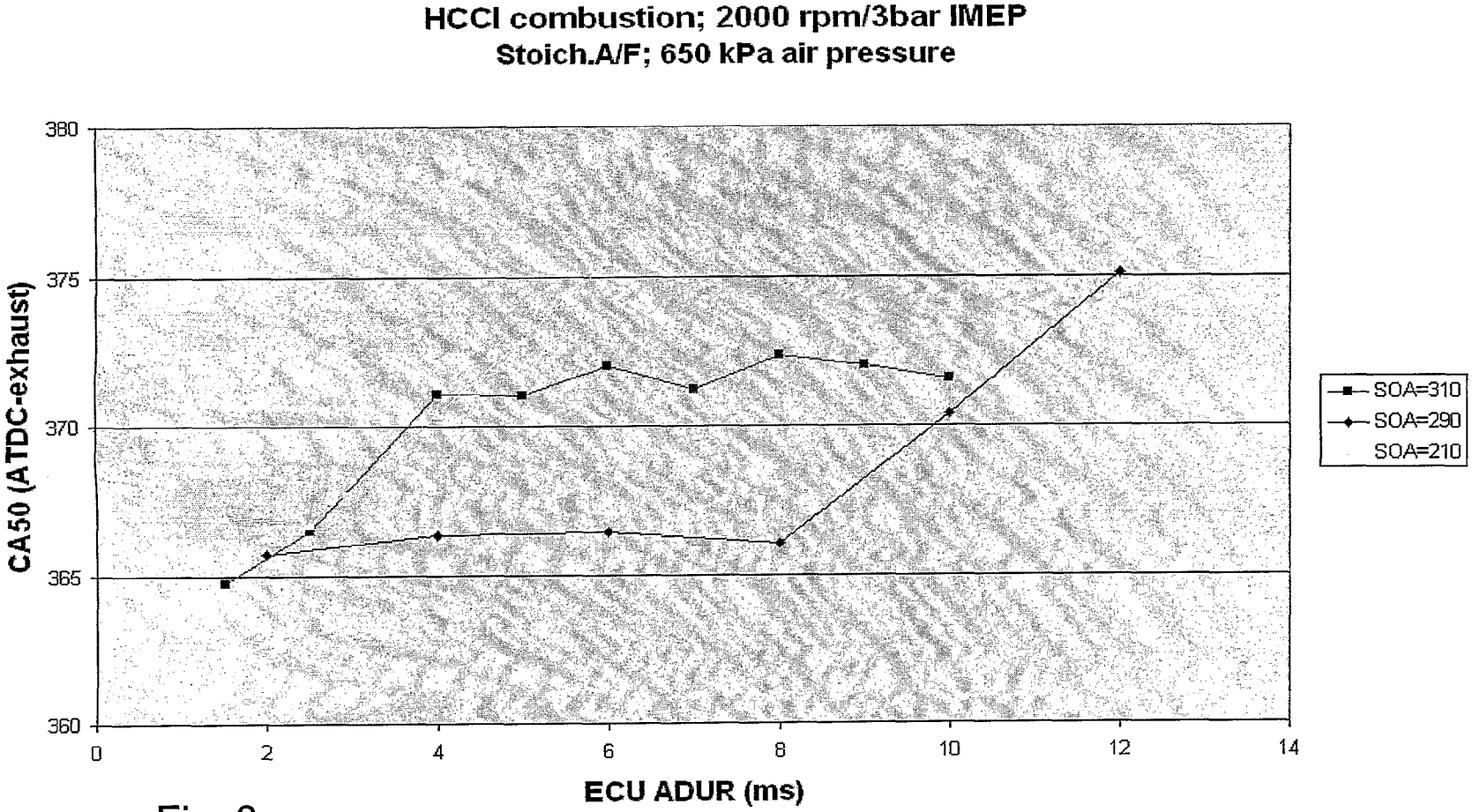
FIG. 3 is a graph demonstrating the effect of air pulse duration in accordance with the method of the present invention on combustion phasing, shown for three different injection timings.
Figure 4:
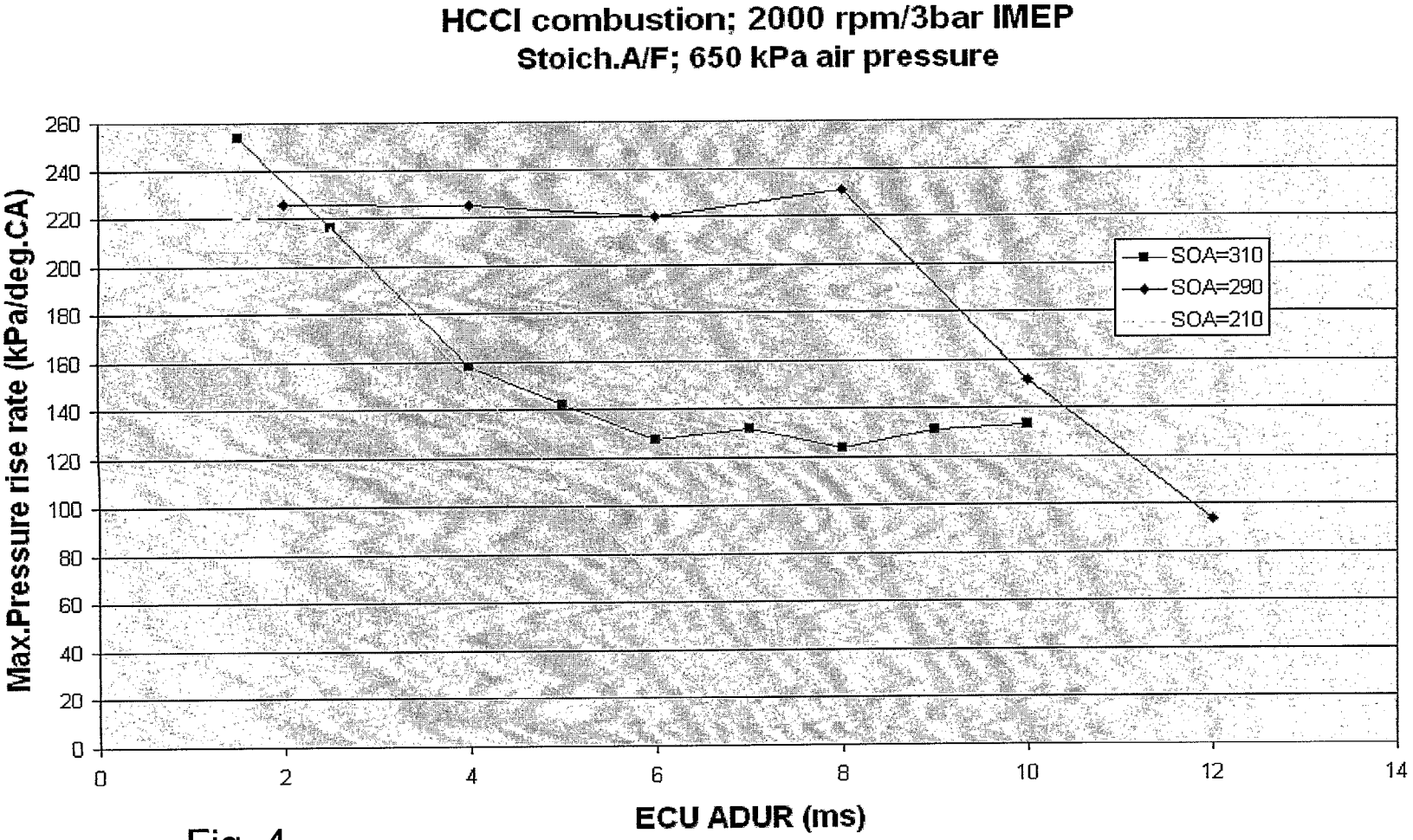
FIG. 4 is a graph demonstrating the effect of air pulse duration in accordance with the method of the present invention on the rate of combustion, shown for three different injection timings.

FIGS. 2 to 4 analyse the performance of a CAI-combustion process in a single cylinder operating at 2000 rpm and delivering an Indicated Mean Effective Pressure (IMEP) of 3 bar with a stoichiometric air/fuel ratio and with an air-assisted direct fuel injection system operating at an air pressure of 650 kPa. Each figure shows the performance of the process at three different injection timings, namely with the air-assisted direct fuel injection commencing (Start Of Air or 'SOA') at 210° BTDC, 290° BTDC and 310° BTDC respectively. It will be noted that 2000 rpm corresponds to an increase of 12° crank angle per msec. The measured results commence at air injection duration (ECU ADUR) of 2 msec, by which time close to the entire fuel load required for the cycle has been supplied into the cylinder.

It can be seen from FIG. 2 that maximum efficiency of fuel consumption (Net Indicated Specific Fuel Consumption or NISFC) is achieved with an air injection duration of about 4 msec, for both the SOA at 290° and 310° cases. In the SOA at 210° case, the piston has commenced its compression stroke by 3 msec and the results are markedly different.

It can be seen from FIG. 3 that the combustion phasing, as expressed by the crank angle at which 50% of the fuel by mass has been burned (CA50), can be varied by increased induction of air, to achieve a desired result.

FIG. 4 demonstrates that the additional injection of air can rapidly reduce the rate of CAI combustion, and therefore the pressure rise within the cylinder. This is clearly a desirable outcome, and suggests that use of this technique can expand the useful range of CAI combustion to higher speed and load conditions.

Figure 5:
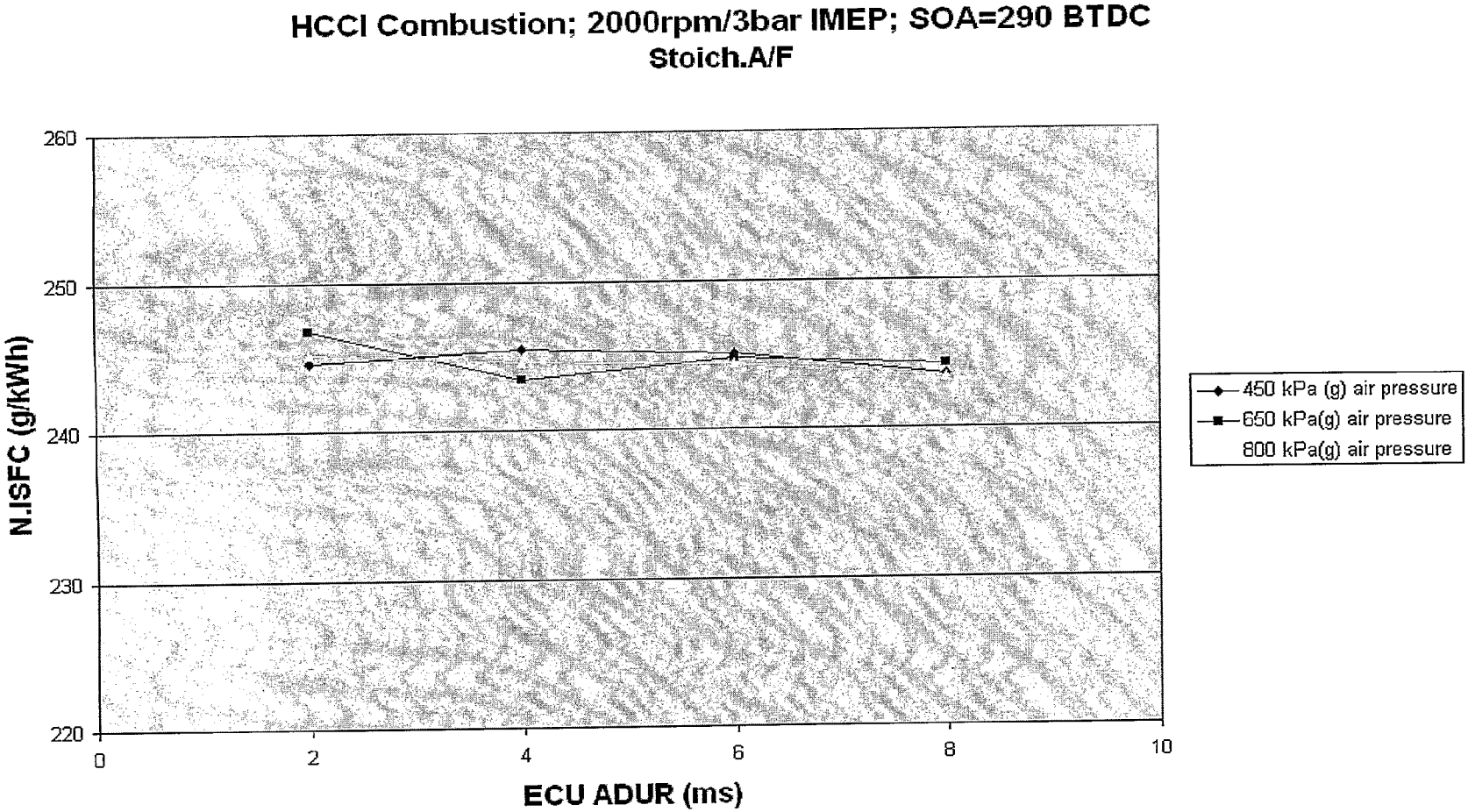
FIG. 5 is a graph demonstrating the effect of air pulse duration in accordance with the method of the present invention on indicated specific fuel consumption, shown for three pressures of air pulse.
Figure 6:
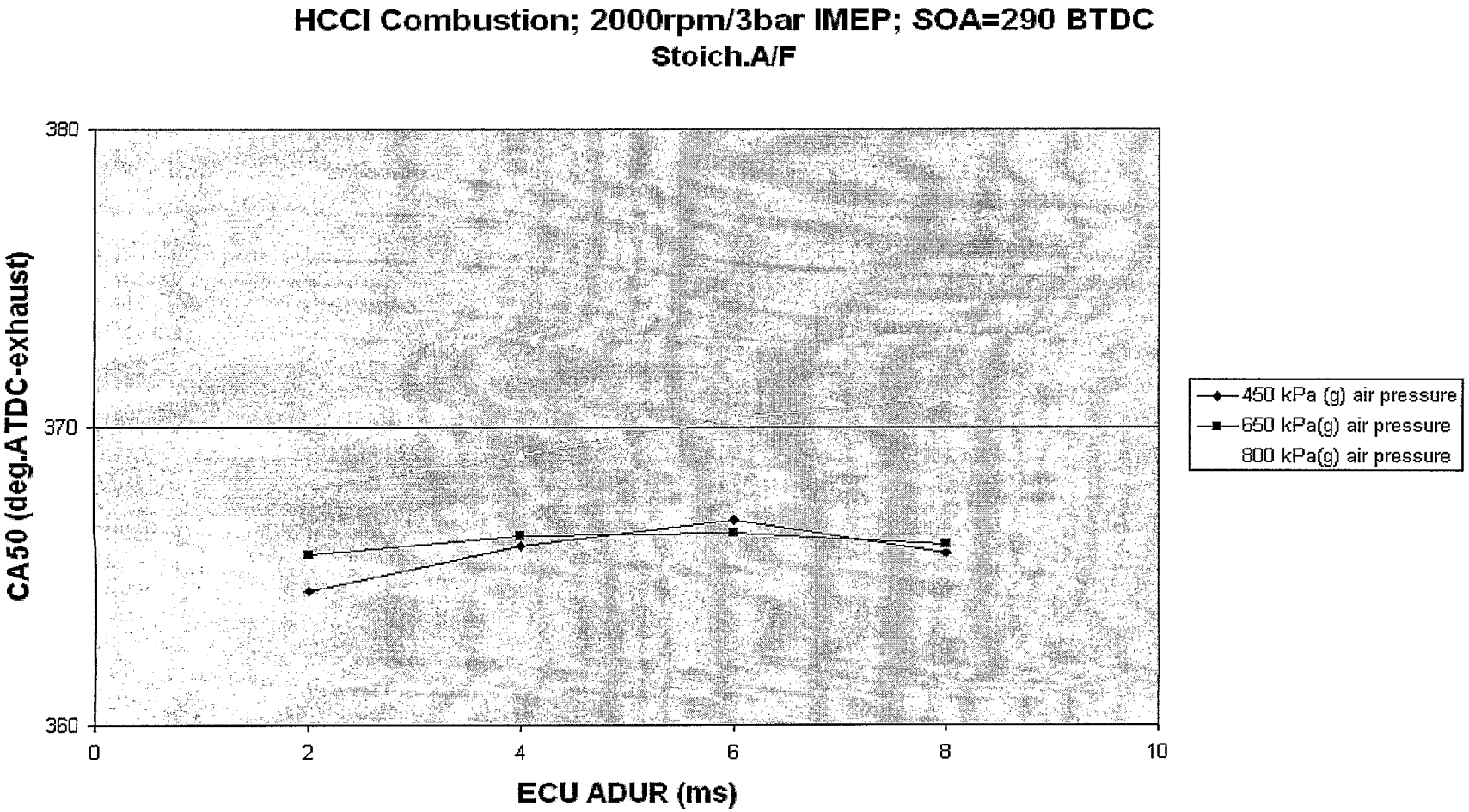
FIG. 6 is a graph demonstrating the effect of air pulse duration in accordance with the method of the present invention on combustion phasing, shown for three different pressures of air pulse.
Figure 7:
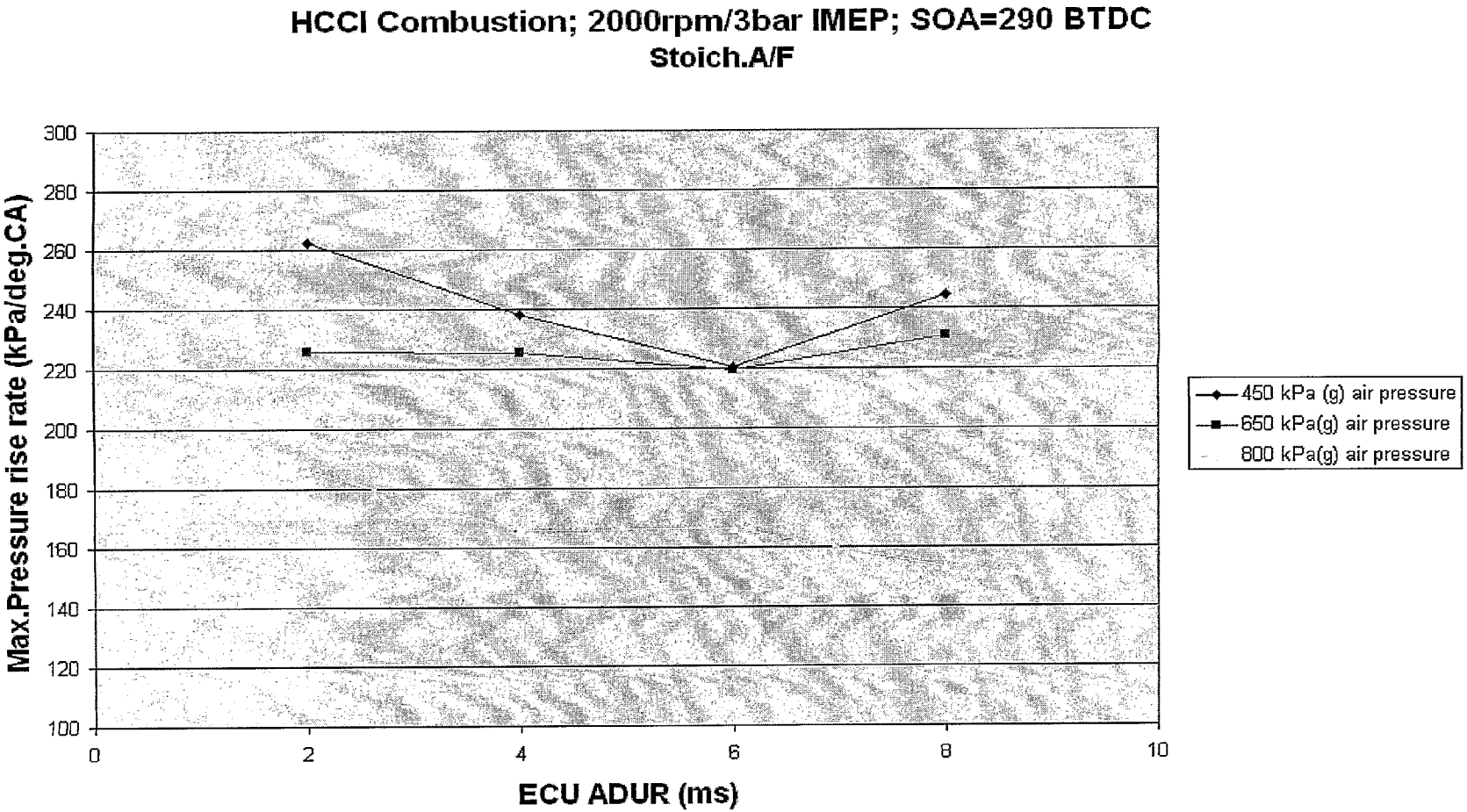
FIG. 7 is a graph demonstrating the effect of air pulse duration in accordance with the method of the present invention on the rate of combustion, shown for three different pressures of air pulse.

FIGS. 5 to 7 show similar results to those of FIGS. 2 to 4, but consider only the SOA at 290° case, and show the effect of varying air-assisted fuel injector operating air pressures between 450 kPa, 650 kPa and 800 kPa. The 650 kPa line is thus identical to the 290° line of FIGS. 2 to 4. The amount of air injected per msec is proportional to the air pressure.

FIG. 5 demonstrates that greater fuel efficiencies may be obtained with longer air injection events, depending on the relevant pressures.

FIGS. 6 and 7 show that combustion phasing and combustion rate are closely related, and are dependent on the quantity of air injected in addition to the duration of injection.

Figure 8:
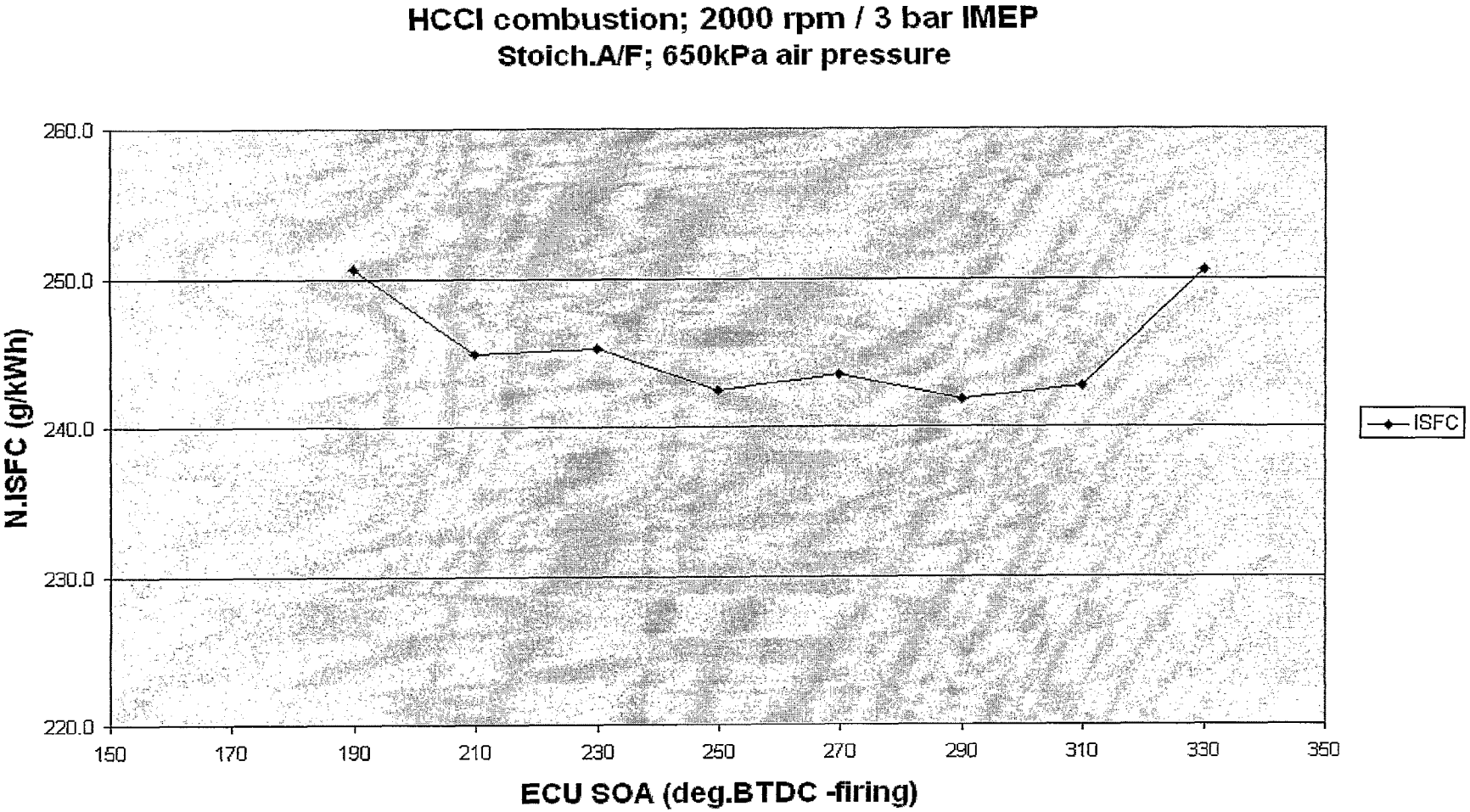
FIG. 8 is a graph demonstrating the effect of injection timing on indicated specific fuel consumption.
Figure 9:
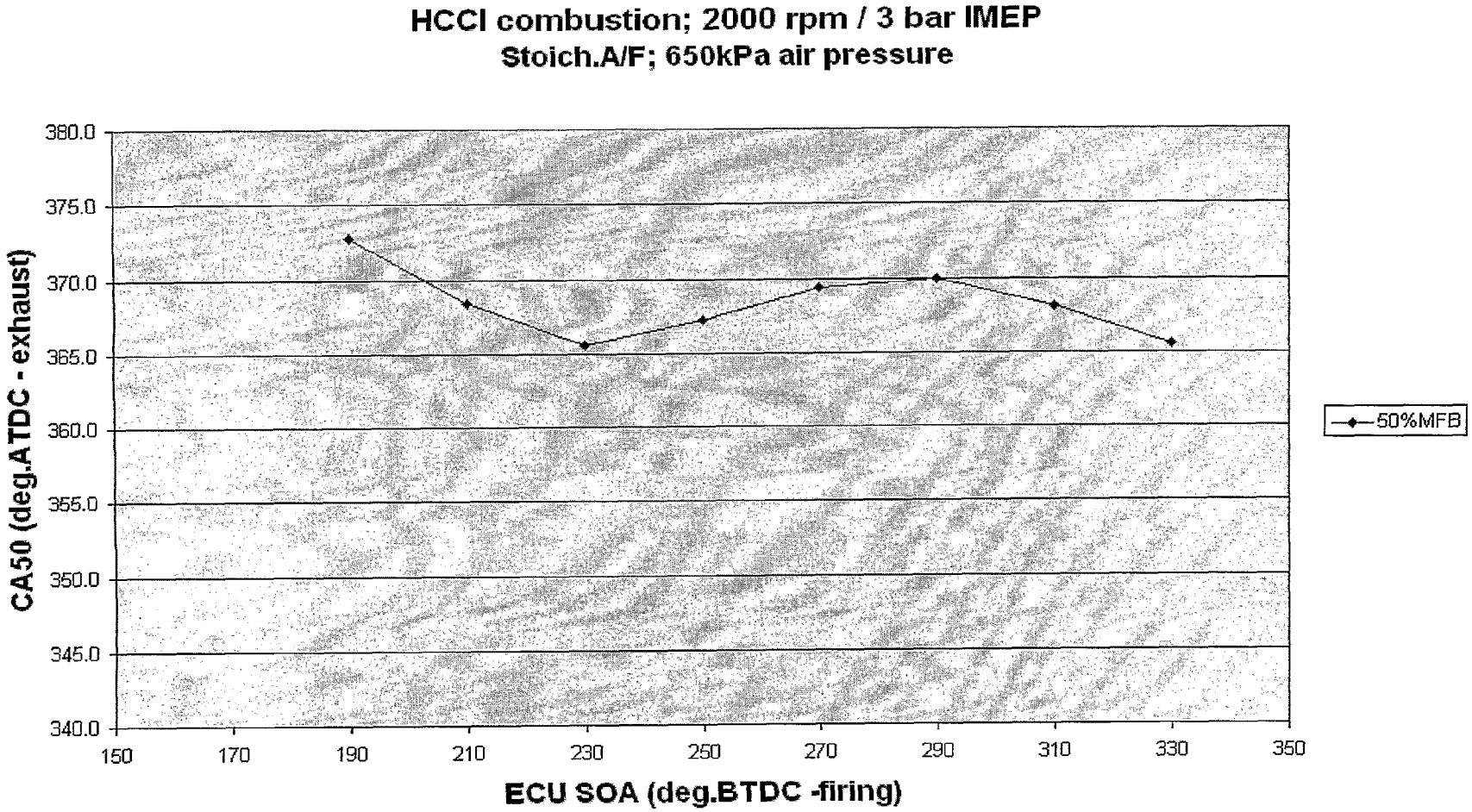
FIG. 9 is a graph demonstrating the effect of injection timing on combustion phasing.
Figure 10:
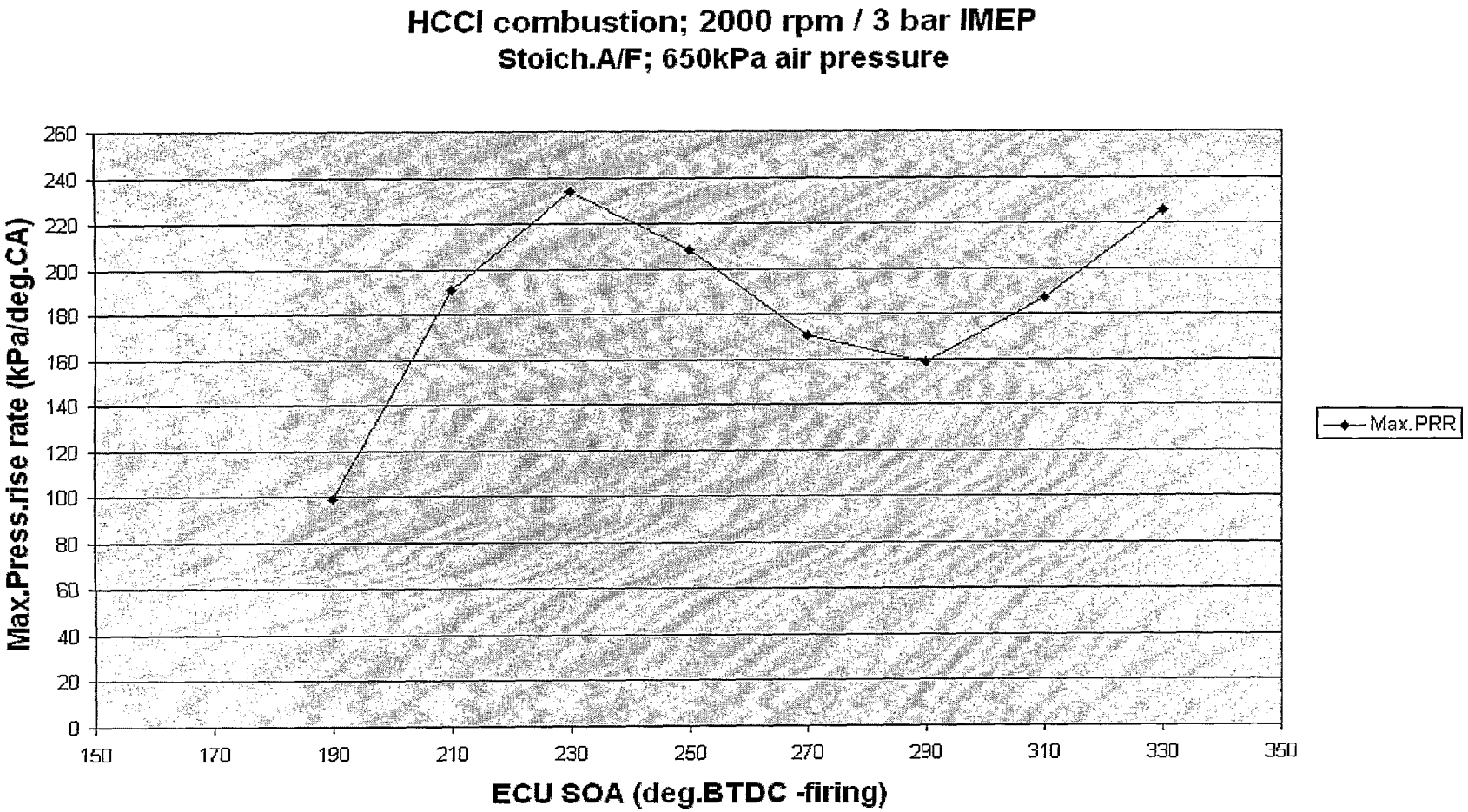
FIG. 10 is a graph demonstrating the effect of injection timing on the rate of combustion.

FIGS. 8 to 10 consider the effect of variation of injection timing given an air-assisted direct fuel injection system operating with an air pressure of 650 kPa and an air duration of 4 msec. These results indicate that an optimal SOA can be obtained (290° in this case).

Figure 11:
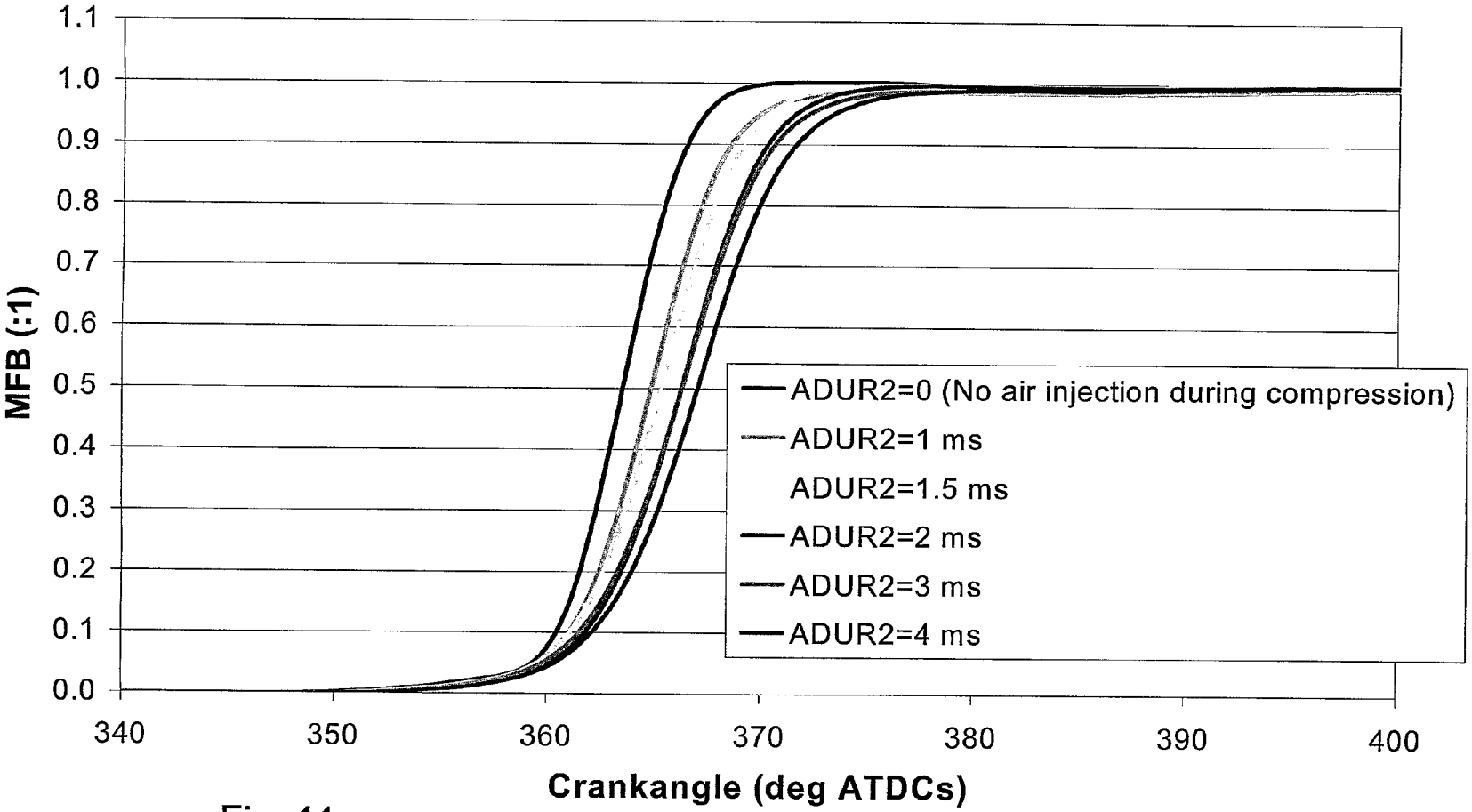
FIG. 11 is a graph demonstrating the effect of introducing a second air injection pulse in accordance with the method of the present invention on the Mass Fraction Burned (MFB) profile.
Figure 12:
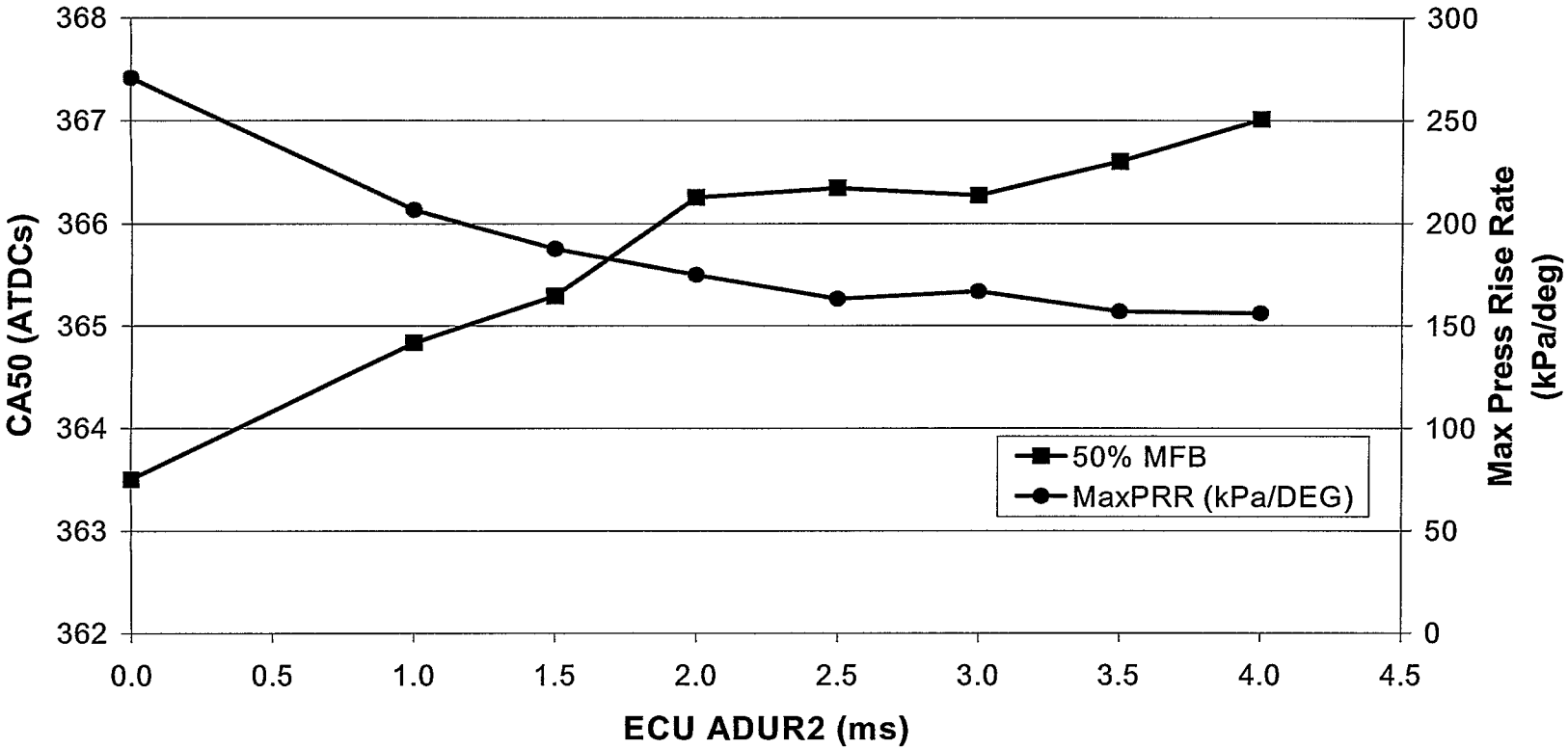
FIG. 12 is a graph demonstrating the effect of a second air pulse on combustion phasing.

FIGS. 11 and 12 demonstrate the effect of introducing an additional air pulse during the combustion stroke. It will be observed that the introduction and subsequent increase of duration of the second air pulse reduces the maximum pressure rise rate and retards combustion phasing.

Figure 13:
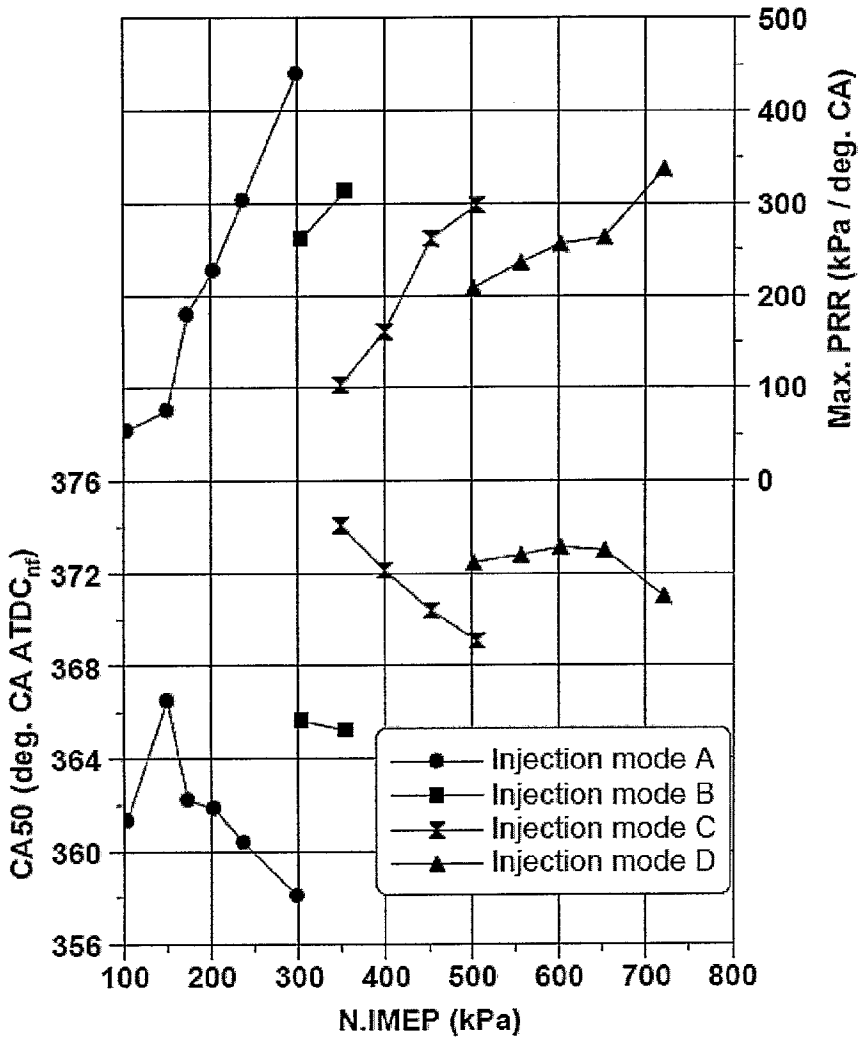
FIG. 13 is a graph demonstrating the use of different injection timings at different engine loads.

FIG. 13 demonstrates an example of the use of the present invention across a range of engine loads. FIG. 13 plots phasing (CA50) and pressure rise against an IMEP ranging from 100 kPa to above 700 kPa, with engine speed maintained at 2000 rpm. It can be seen that acceptable results are obtained by moving between a number of different injection modes as the load increases. In the figure, injection mode A corresponds to a single injection of air and fuel early in the cycle, during the period between closure of the exhaust port and opening of the inlet port (SOA between 450 and 400 deg. BTDC). Injection mode B corresponds to a single injection of air and fuel occurring somewhat later in the cycle, during the intake stroke (SOA between 330 and 210 deg. BTDC). Injection mode C adds a further injection of air to mode C, the injection of air occurring during the compression stroke (SOA between 105 and 60 deg. BTDC). In mode D, injections of air and fuel, or air alone, are made at each of the above three mentioned times.

It will thus be seen that the use of additional air injection, under appropriate conditions, can provide a degree of control over the CAI combustion process and thus help operate the CAI combustion process at an optimum condition. Additionally, the method can enhance the range over which CAI combustion can be effectively used and allow for better transition between combustion modes. This in turn can provide significant benefits in fuel efficiency, reduced emissions and reduced combustion noise.

Modifications and variations as would be apparent to a skilled addressee are deemed to be within the scope of the present invention.

The invention claimed is:

1. A method for controlling Controlled-Auto-Ignition (CAI)-combustion within a cylinder, the method including:

using an air-assisted injector of an air-assisted direct fuel injection system to inject fuel and air into the cylinder; and further using the same air-assisted injector to inject additional air into the cylinder to alter conditions within the cylinder prior to ignition in response to measured operating parameters.

2. The method for controlling CAI-combustion as claimed in claim 1, where the conditions altered include at least one of a temperature or a pressure, and the motion of the fuel/air mix within the cylinder.

3. The method for controlling CAI-combustion as claimed in claim 1, wherein the additional air is injected by increasing the duration of air injection without increasing the quantity of fuel injected.

4. The method for controlling CAI-combustion as claimed in claim 1, wherein the method employs multiple pulses of the additional air, or of an air-fuel mix, during each cycle.

5. The method for controlling CAI-combustion as claimed in claim 4, wherein the pulses of additional air, or air-fuel pulses, are added before or after a primary air pulse.

6. The method for controlling CAI-combustion as claimed in claim 4, wherein during low speed and load conditions an additional air-fuel injection event is affected close to completion of an engine compression stroke.

7. The method for controlling CAI-combustion as claimed in claim 6, wherein the additional fuel is ignited by a spark.

8. The method for controlling CAI-combustion as claimed in claim 1, wherein the operating parameters measured include engine speed, engine vibration, engine torque, in-cylinder ionisation and/or in-cylinder pressure.

9. The method for controlling CAI-combustion as claimed in claim 1, wherein the additional injected air is less than 5% of the air intake through an intake valve.

10. The method for controlling CAI-combustion as claimed in claim 9, wherein the additional injected air is about 2% to 3% of the air intake through the intake valve.

11. The method for controlling CAI-combustion as claimed in claim 1, wherein the calculation of appropriate timings for air injection are made independently for each cylinder.

12. The method for controlling CAI-combustion as claimed in claim 11, wherein the calculation of appropriate timings for air injection is made for each successive cylinder cycle.

13. A method of enhancing stability of CAI-combustion within a cylinder employing exhaust-gas retention, the method including altering the timing of fuel and air injections into the cylinder from an air-assisted injector of an air-assisted direct injection fuel system according to engine speed and/or load.

14. The method of enhancing stability of CAI-combustion as claimed in claim 13, the method used to enhance stability of CAI-combustion at or near engine idle by causing fuel to be injected into the cylinder earlier than when the engine is under load.

15. The method of enhancing stability of CAI-combustion as claimed in claim 13, used to enhance stability of CAI-combustion under load by injecting additional air so as to retard combustion.

16. A method for controlling Controlled-Auto-Ignition (CAI)-combustion within a cylinder, the method including:

supplying air to the cylinder during an intake stroke, supplying fuel into the cylinder from an air-assisted injector during a compression stroke, and injecting additional air into the cylinder in excess of the intake air in order to alter conditions within the cylinder prior to ignition in response to measured operating parameters, the additional air being injected by use of the air assisted injector.

17. The method for controlling CAI combustion as claimed in claim 16, wherein the injected air is less than 5% of the intake air.

18. The method for controlling CAI combustion within a cylinder as claimed in claim 17, wherein the injected air is about 2-3% of the intake air.

19. The method for controlling CAI combustion as claimed in claim 16, the method including injecting the additional air into the cylinder at a pressure at least 2.5 times the intake air pressure to alter conditions within the cylinder prior to ignition in response to measured operating parameters.

20. A method for controlling CAI combustion as claimed in claim 16, the method including injecting the additional air into the cylinder at a pressure at least 1.5 times the intake air pressure to alter conditions within the cylinder prior to ignition in response to measured operating parameters.

21. The method for controlling CAI combustion as claimed in claim 16, the method including injecting the additional air at about 650 kPa into the cylinder to alter conditions within the cylinder prior to ignition in response to measured operating parameters.

22. The method for controlling CAI-combustion as claimed in claim 1, further comprising:

altering the timing of fuel and air injections into the cylinder from an air-assisted injector of an air-assisted direct injection fuel system according to engine speed and/or load.

23. The method for controlling CAI-combustion as claimed in claim 22, the method used to enhance stability of CAI-combustion at or near engine idle by causing fuel to be injected into the cylinder earlier than when the engine is under load.

* * * * *

UNITED STATES PATENT AND TRADEMARK OFFICE

CERTIFICATE OF CORRECTION

PATENT NO. : 8,718,901 B2
APPLICATION NO. : 12/665765
DATED : May 6, 2014
INVENTOR(S) : Brewster et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1077 days.

Signed and Sealed this
Twenty-ninth Day of September, 2015

Michelle K. Lee

Michelle K. Lee
*Director of the United States Patent and Trademark Office*